US010145661B2

(12) United States Patent
Miller et al.

(10) Patent No.: US 10,145,661 B2
(45) Date of Patent: Dec. 4, 2018

(54) MULTI-WARHEAD MUNITION WITH CONFIGURABLE SEGMENTED WARHEAD

(71) Applicant: Textron Innovations Inc., Providence, RI (US)

(72) Inventors: Clayton Warren Miller, Reading, MA (US); James Andrew Hollowell, North Andover, MA (US)

(73) Assignee: Textron Innovations Inc., Providence, RI (US)

( * ) Notice: Subject to any disclaimer, the term of this patent is extended or adjusted under 35 U.S.C. 154(b) by 85 days.

(21) Appl. No.: 15/355,388

(22) Filed: Nov. 18, 2016

(65) Prior Publication Data

US 2017/0299358 A1 Oct. 19, 2017

Related U.S. Application Data

(60) Provisional application No. 62/256,815, filed on Nov. 18, 2015.

(51) Int. Cl.
*F42B 12/20* (2006.01)
*F42B 12/22* (2006.01)
*F42B 12/16* (2006.01)

(52) U.S. Cl.
CPC ..... *F42B 12/208* (2013.01); *F42B 12/16* (2013.01); *F42B 12/202* (2013.01); *F42B 12/204* (2013.01); *F42B 12/22* (2013.01)

(58) Field of Classification Search
CPC ..... F42B 12/22; F42B 12/24; F42B 12/02; F42B 12/04; F42B 12/12; F42B 12/34;
(Continued)

(56) References Cited

U.S. PATENT DOCUMENTS 948,148 A * 2/1910 Schenk ..... F42B 12/34 102/508
3,960,085 A * 6/1976 Abernathy ..... F42B 12/22 102/492

(Continued)

FOREIGN PATENT DOCUMENTS

DE 102010045516 A1 * 3/2012 ..... F42B 12/24
DE 102005001891 A1 * 2/2013 ..... F42B 12/10

(Continued)

OTHER PUBLICATIONS

William P. Walters and Daniel R. Scheffler, "The Pyramid Liner Concept", report, Jun. 2003, ARL-TR-2995, Army Research Laboratory, Aberdeen Proving Ground, MD 21005-5066.

*Primary Examiner* — Benjamin P Lee
(74) *Attorney, Agent, or Firm* — BainwoodHuang

(57) ABSTRACT

A multi-warhead munition includes a first cylindrical warhead having a cavity filled with high explosive, and a second cylindrical warhead offset axially from the first cylindrical warhead. The second cylindrical warhead is a transformable, segmented warhead including a plurality of segments each having an outer segment face bounding a cavity of the segment filled with high explosive. The segments are elongated and mounted at one end for rotation away from an axis of the munition to an open position in which the segment faces are pointed in a forward direction for detonation. Rotation may generally be somewhere in a broad range from about 105 degrees to about 170 degrees, obtaining different effects in different sub-ranges. The munition includes first and second detonators for the first and second cylindrical warheads respectively, the second detonator simultaneously detonating the segments of the second cylindrical warhead.

18 Claims, 7 Drawing Sheets

(58) Field of Classification Search
CPC ..... F42B 12/60; F42B 12/58; F42B 12/208; F42B 12/204; F42B 12/202; F42B 12/00
See application file for complete search history.

(56) References Cited

U.S. PATENT DOCUMENTS

| | | | | | |
|---|---|---|---|---|---|
| 4,455,943 | A * | 6/1984 | Pinson | F42B 12/58 | 102/393 |
| 4,625,646 | A * | 12/1986 | Pinson | F42B 12/58 | 102/393 |
| 6,619,210 | B1 * | 9/2003 | Spivak | F42B 12/10 | 102/475 |
| 6,834,593 | B2 * | 12/2004 | Nardone | F42B 12/58 | 102/393 |
| 7,007,607 | B1 * | 3/2006 | Fong | F42B 12/10 | 102/400 |
| 7,066,093 | B2 * | 6/2006 | Ronn | F42B 12/32 | 102/489 |
| 8,091,482 | B2 * | 1/2012 | Rotkopf | F42B 1/02 | 102/400 |
| 8,622,001 | B1 * | 1/2014 | Patel | F42B 12/34 | 102/494 |
| 8,955,443 | B1 * | 2/2015 | Miller | F42B 12/10 | 102/331 |
| 9,068,807 | B1 * | 6/2015 | Thomas | F42B 15/10 | |
| 9,310,172 | B2 * | 4/2016 | Zussman | F42B 12/24 | |
| 9,476,682 | B1 * | 10/2016 | Powell | F42B 12/16 | |
| 2003/0126978 | A1 * | 7/2003 | Rastegar | F41H 11/02 | 89/1.11 |
| 2003/0177933 | A1 * | 9/2003 | Fortner | F42B 12/16 | 102/476 |
| 2008/0307994 | A1 * | 12/2008 | Gustafsson | F41H 11/02 | 102/489 |
| 2009/0288573 | A1 * | 11/2009 | Rotkopf | F42B 1/02 | 102/476 |
| 2010/0162915 | A1 * | 7/2010 | Rastegar | F41J 2/00 | 102/400 |
| 2014/0251173 | A1 * | 9/2014 | Schneider | F42B 12/60 | 102/489 |
| 2015/0033971 | A1 | 2/2015 | Miller | | |
| 2015/0345919 | A1 * | 12/2015 | Leach | F42B 12/34 | 102/502 |
| 2016/0015499 | A1 * | 1/2016 | Scott | F42B 7/08 | 604/130 |
| 2017/0322003 | A1 * | 11/2017 | Scott | F42B 12/54 | |

FOREIGN PATENT DOCUMENTS

| | | | | |
|---|---|---|---|---|
| EP | 0811823 | A1 | 12/1997 | |
| EP | 1832838 | A1 | 9/2007 | |
| GB | 2354574 | A * | 3/2001 | F42B 12/22 |
| WO | 2008059477 | A2 | 5/2008 | |

* cited by examiner

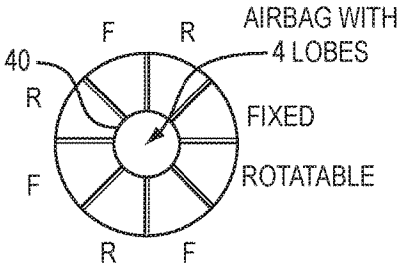
FIG. 10
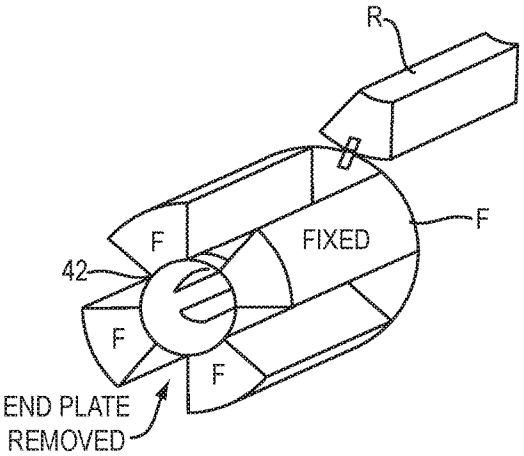
FIG. 11
FIG. 12
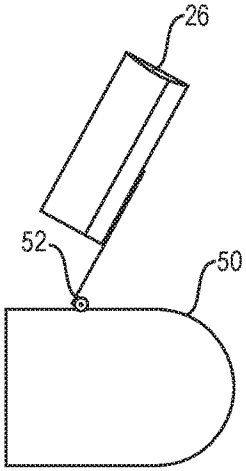
FIG. 13

MULTI-WARHEAD MUNITION WITH CONFIGURABLE SEGMENTED WARHEAD

BACKGROUND

The invention is generally in the field of ballistic munitions such as missiles, artillery rounds, etc.

SUMMARY

A disclosed multi-warhead munition supports a variety of configurations and provides for flexible use against a variety of targets. The munition may utilize a warhead of the general type described in US patent application publication US20150033971 entitled "Warhead having Selectable Axial Effects," providing significant additional/alternative effects and enabling one munition to defeat a variety of different targets by taking on different geometries.

US20150033971 describes a cylindrical explosively formed penetrator (EFP) warhead which is split into longitudinal sub-warheads or segments having essentially wedge-shaped cross-sections. There is also a central, conical warhead affixed to the EFP liner. The longitudinal, wedge-shaped segments are attached/hinged at the forward end of the EFP warhead and are free to rotate outward under the proper conditions. While in the initial, stowed geometry the longitudinal segments together form a cylindrical fragmentation warhead. Upon detonation these segments create a radially-outward moving cylindrical-shaped cloud of anti-personnel or anti-material fragments. When commanded, the longitudinal segments rotate outward to about 90 degrees so that they are orthogonal to the missile axis and the fragments generated by the segments are projected forwardly.

In one aspect of the present invention, segments of a transformable warhead are rotated less than or more than 90 degrees. In particular, with simultaneous detonation of a set of identical, symmetrically arranged segments (e.g., four segments) rotated to about 135 degrees, for example, a forward moving cloud of fragments is created as well as a forward-moving, higher velocity jet of fragment material. The tip velocity of the jet of fragment material may be 2 to 3 times the fragment launch velocity. This may be similar to jetting observed in conical-lined, shaped charge warheads. The jet may have the capability to penetrate hardened targets such as rolled homogeneous armor (RHA). The jet produced by such a warhead could also serve as a precursor to an EFP slug or jet produced by a separate (aft) warhead of a multi-warhead munition.

One practical application might be to clear a path through explosive reactive armor (ERA) when attacking an armored vehicle from a short standoff distance. The jet or EFP slug of the aft warhead follows a precursor jet created by the transformable warhead, which has cleared the ERA from the path of the attacking penetrator. Many other warhead variants are possible. The EFP warhead could have a standard geometry, and the transformable warhead with the segments in a folded (non-articulated) position could function as a full cylindrical fragmenting warhead located in front of the EFP. Against area targets (personnel in the open) the segments may not be rotated outward but rather detonated in place to create a radially expanding cylindrical cloud of fragments. Against a light vehicle (point target) the segments can be rotated to 90 degrees and detonated a short distance from the vehicle. For a small group of targets the segments could be rotated to only 60 degrees, for example, to obtain wider coverage. For a concrete building target the segments might be rotated to 125 degrees to form a large diameter jet and slug combination to perforate the wall and produce some spallation effects, with the EFP or shaped charge aft warhead also being detonated to create follow-through effects. Against an armored target the longitudinal warheads could be rotated to 150 degrees to create a higher velocity jet for clearing the ERA as described above.

Even in the absence of an aft EFP warhead, the cylindrical array of wedge-shaped cross-section, longitudinal warhead segments of a transformable warhead could be effective against a spectrum of targets. The warhead segments may include fragmenting liners that may be naturally fragmenting (smooth steel or other metal without notches) or they may be notched to form uniform size fragments when used in the anti-personnel or anti-material mode. The fragmenting liners could be circular arcs with uniform thickness or some more complicated geometry. One approach might be a small EFP cross-section to make a linear EFP (LEFP) from the center of the liner and make fragments from arc—shaped liner sections on either side. This would create a more massive jet from the four warheads as the four LEFPs interact along the missile axis. An additional smaller caliber follow-through thermobaric warhead could also be incorporated as the rear-most warhead of a series of 3 warhead types (transformable, shaped charge and thermobaric) on a single missile.

One advantage of the presently disclosed munition is providing more flexible use of a single weapon. Previously, a number of different warheads and or missiles were needed for different target types. For example, a known lightweight, shoulder-fired missile has an array of six different warheads to be used on six different types of targets. The disclosed munition can potentially reduce this to a single large shaped charge plus a single transformable warhead which can be adjusted to the target being attacked. In a military setting, the munition might be deployed in shoulder-fired, crew launched and aircraft-launched missiles. It could also be used in both military and commercial demolition.

Now more particularly, a multi-warhead munition is disclosed that includes:

- a first cylindrical warhead having a cavity filled with high explosive;
- a second cylindrical warhead offset axially from the first cylindrical warhead, the second cylindrical warhead being a segmented warhead including a plurality of segments each having an outer segment face bounding a cavity of the segment filled with high explosive, the segments being elongated and mounted at one end for rotation away from an axis of the munition to an open position in which the segment faces are pointed in a forward direction for detonation; and
- first and second detonators for the first and second cylindrical warheads respectively, the second detonator being configured and operative to simultaneously detonate the segments of the second cylindrical warhead.

In one embodiment, the second cylindrical warhead is disposed axially forward of the first cylindrical warhead. In this arrangement, the segments of the second cylindrical warhead may be mounted for rotation by a rotation angle greater than 90 degrees toward a focal region at which each of the segment faces is pointed, the focal region located on the axis of the munition at a forward end of the second cylindrical warhead. The rotation angle may be in a range between 105 degrees and 170 degrees. The first and second detonators may be co-configured to detonate the second cylindrical warhead before the first cylindrical warhead.

Also in such an embodiment, the second cylindrical warhead may be configurable into a plurality of deployment configurations including a folded configuration and an open configuration, the open configuration having the segments rotated away from the axis of the munition by the rotation angle of greater than 90 degrees, the folded configuration having the segments extending parallel to the axis of the munition with the segment faces pointed radially away from the axis of the munition for detonation. The open configuration may be a first open configuration and the rotation angle of greater than 90 degrees a first rotation angle, and the deployment configurations may further include a second open configuration having the segments rotated away from the axis of the munition by a second rotation angle of substantially 90 degrees for detonation. Further, there may be two variants of the first open configuration, a first variant having the first and second detonators configured and operative to simultaneously detonate the first cylindrical warhead and the segments of the second cylindrical warhead, and a second variant having the first and second detonators configured and operative to detonate the segments of the second cylindrical warhead before detonating the first cylindrical warhead.

The segments of the second warhead may include rotating segments as well as non-rotating segments extending parallel to the axis of the munition with segment faces pointed radially away from the axis of the munition for detonation. In this case the second cylindrical warhead may be configurable into a plurality of deployment configurations including first and second configurations, the first configuration having the second detonators configured and operative to detonate the rotating and non-rotating segments simultaneously, the second configuration having the second detonators configured and operative to detonate the rotating segments without detonating the non-rotating segments.

The multi-warhead munition may further include a nose member to which the segments are hingedly attached for rotation. The segments may be spaced from a point of hinged attachment to become spaced from the nose member in the open position to locate the focal region ahead of the nose member.

In another type of embodiment, the multi-warhead munition may further include a third cylindrical warhead axially displaced from the first and second cylindrical warheads. The second cylindrical warhead may be located forward of both the first and third cylindrical warheads. In one specific arrangement, the first cylindrical warhead is a shaped charge warhead located aft of the second cylindrical warhead, and the third cylindrical warhead is a thermobaric warhead located aft of the first cylindrical warhead.

In another type of embodiment, the second cylindrical warhead is located aft of the first cylindrical warhead, and the segments of the second cylindrical warhead are mounted for rotation by a rotation angle no more than 90 degrees. The first cylindrical warhead may be a shaped charge.

In some embodiments, the segment faces may include a respective elongated liner configured to form a penetrating slug upon detonation of the segment.

Also in some embodiments, the segments may be linear segments with wedge-shaped cross sections having respective interior apexes facing the axis of the munition when the segments are in a folded, non-rotated position.

In another aspect, a method is disclosed of engaging a target with a multi-warhead munition including a cylindrical shaped charge warhead aft of a cylindrical transformable warhead. The method includes:

classifying the target as one of an area target, a point-and-area target, a hardened-point-and-area target, and a hardened-point target;

selecting a configuration of the transformable warhead based on the classifying of the target, including:

selecting a first configuration based on classifying the target as an area target, the first configuration having (1) segments of the transformable warhead in a folded position to generate a hail of fragmentation projectiles radially away from the munition upon detonation, and (2) first and second detonators configured to detonate the shaped charge warhead and transformable warhead simultaneously;

selecting a second configuration based on classifying the target as a point-and-area target, the second configuration having (1) segments of the transformable warhead in a first open position to generate a hail of fragmentation projectiles axially forward upon detonation, the segments being rotated away from an axis of the munition to a first rotation angle of substantially 90 degrees to direct respective segment faces in a forward direction, and (2) the first and second detonators configured to detonate the shaped charge warhead and transformable warhead simultaneously;

selecting a third configuration based on classifying the target as a hardened-point-and-area target, the third configuration having (1) the segments of the transformable warhead in a second open position to generate a hail of fragmentation projectiles axially forward upon detonation, the segments being rotated away from the axis of the munition to a second rotation angle of greater than 90 degrees to point the segment faces to a focal region ahead of the munition, and (2) the first and second detonators configured to detonate the shaped charge warhead and transformable warhead simultaneously; and selecting a fourth configuration based on classifying the target as a hardened-point target, the fourth configuration having (1) the segments of the transformable warhead in the second open position, and (2) the first and second detonators configured to detonate the shaped charge warhead after detonating the transformable warhead; and delivering the munition with selected configuration to the target for detonation.

The selecting may be performed prior to launch of the munition from a vehicle. The munition may include target acquisition electronic circuitry operative to automatically perform the classifying and selecting during delivery of the munition to the target.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

FIG. 10 is a schematic end view of a transformable warhead in a folded position;

FIG. 11 is a schematic diagram of a portion of a transformable warhead;

FIG. 12 is a schematic diagram of a portion of a transformable warhead with a segment in a folded position;

FIG. 13 is a schematic diagram of a portion of a transformable warhead with a segment in an open position;

DETAILED DESCRIPTION

Figure 1:
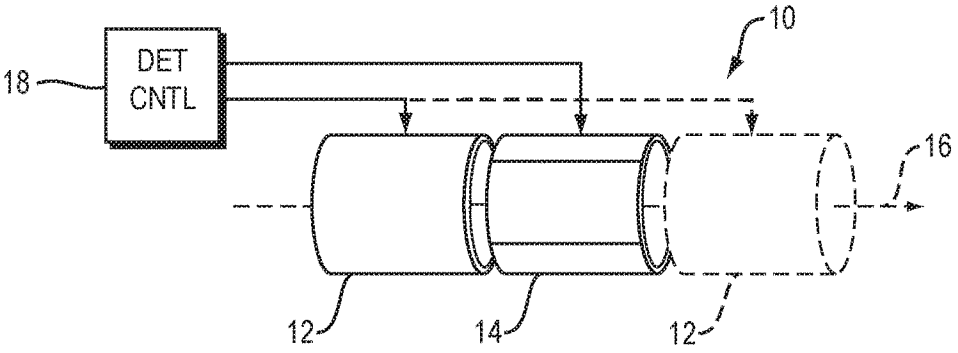
FIG. 1 is a quasi-mechanical diagram of a multi-warhead munition.

FIG. 1 shows part of a multi-warhead munition 10 having a cylindrical first warhead 12 and a cylindrical second warhead 14 arranged on an axis 16 of the munition 10. The second warhead 14 is segmented in a particular manner as described more below, and is also referred to herein as a "transformable" warhead. The munition 10 may be a missile, artillery round, or other specific type, with the forward or flight direction toward the right in FIG. 1. The solid-line depiction shows the first warhead 12 arranged behind or "aft" of the second warhead 14, but as indicated in broken lines the first warhead 12 may alternatively be ahead or "forward" of the second warhead 14. Additional details of each of these arrangements are provided below. As also shown below, there may be additional warheads in some embodiments.

Each warhead 12, 14 generally includes one or more cavities packed with high explosive that is detonated to produce designed-for effects. The munition 10 generally includes some type of detonation control (DET CNTL) 18 responsible for initiating detonation of the warheads 12, 14 at a desired time. In some cases the warheads 12, 14 may be detonated simultaneously, while in other cases there may be a slight delay between them to establish a desired sequence. Higher-level control, such as the timing of detonation relative to proximity to a target, may be established upon launch or other deployment of the munition 10, or it may be performed more autonomously by the munition 10 itself based on machine awareness. Examples are given below. Apparatus and methods for detonation are generally known and are not elaborated herein.

Figure 4:
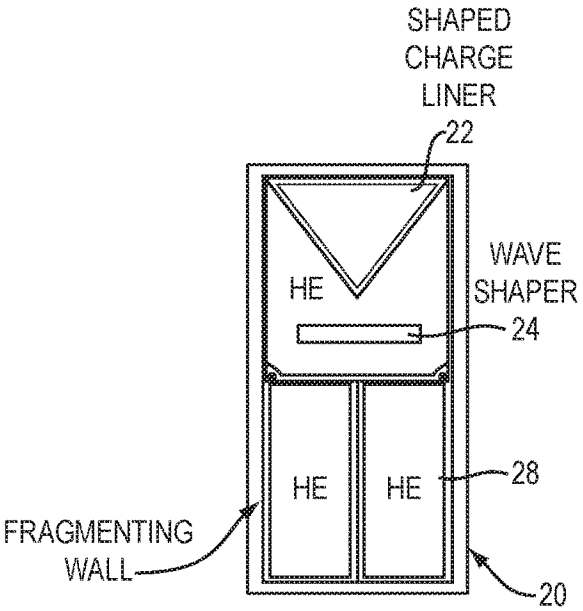
FIG. 4 is a schematic section view of the first type of two-warhead munition.
Figure 3:
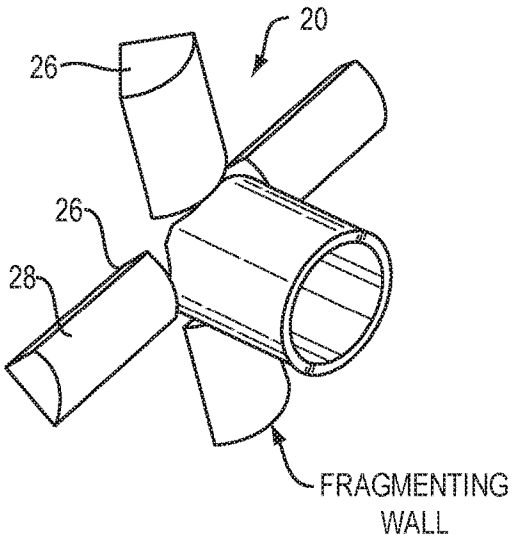
FIGS. 2 and 3 are isometric views of a first type of two-warhead munition.
Figure 2:
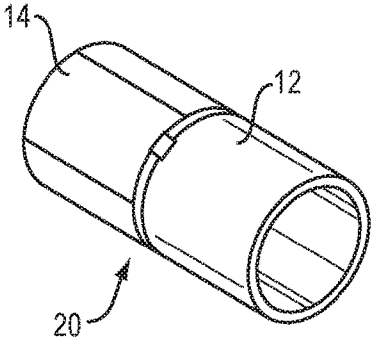

FIGS. 2-4 illustrate a first type of two-warhead munition 20, having the transformable warhead 14 aft of the first warhead 12. FIG. 2 shows a closed or folded position that is maintained up to a time of opening to an open or deployed position illustrated in FIG. 3. FIG. 4 is a cross-section showing the cavities of high explosive (HE) and other structure. In this case the first warhead 12 is a shaped charge warhead having an inverted liner 22 at the forward end and, in this embodiment, a wave shaper 24 (FIG. 4). The transformable warhead 14 has four quarter-cylinder segments 26 that are hinged at a common structure (e.g., the aft end of the first warhead 12) for outward rotation. The segments 26 are linear segments with wedge-shaped cross sections having respective interior apexes facing the axis of the munition 20 when the segments are in the folded, non-rotated position (FIG. 2).

In the open or deployed position of FIG. 3, the rounded sidewalls 28 of the segments 26 face forward. While in the initial, folded position, the segments 22 together form a cylindrical fragmentation warhead. Upon detonation it creates a radially-outward moving cylindrical-shaped cloud of anti-personnel or anti-material fragments. An example of this use is described below. In the warhead 20 of FIGS. 2-4, the segments 22 are commanded to rotate outward to about 90 degrees to become orthogonal to the munition axis 16, so that the sidewall fragments generated upon detonation of the segments 26 are projected in essentially the forward axial direction. This arrangement expands the capability of a missile to successfully engage a variety of targets, including personnel targets for example, while retaining a shaped charge anti-armor capability.

Figure 5:
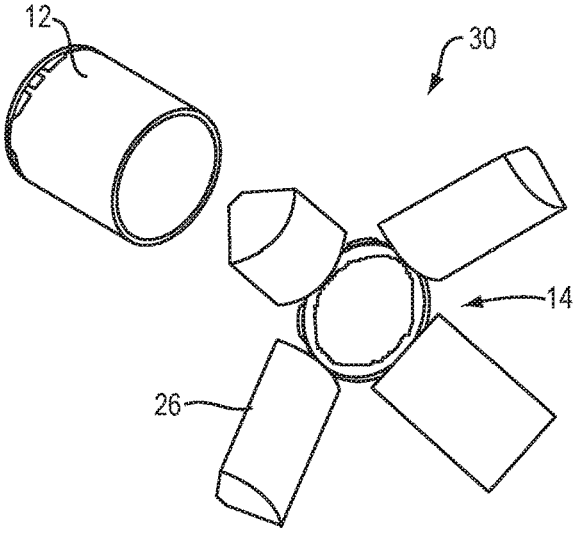
FIG. 5 is an isometric view of a second type of two-warhead munition.
Figure 6:
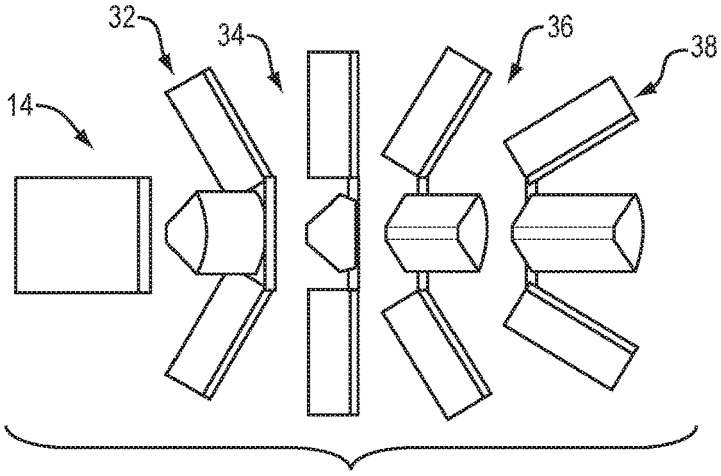
FIGS. 6 and 7 are views of deployment positions of the second type of two-warhead munition.
Figure 7:
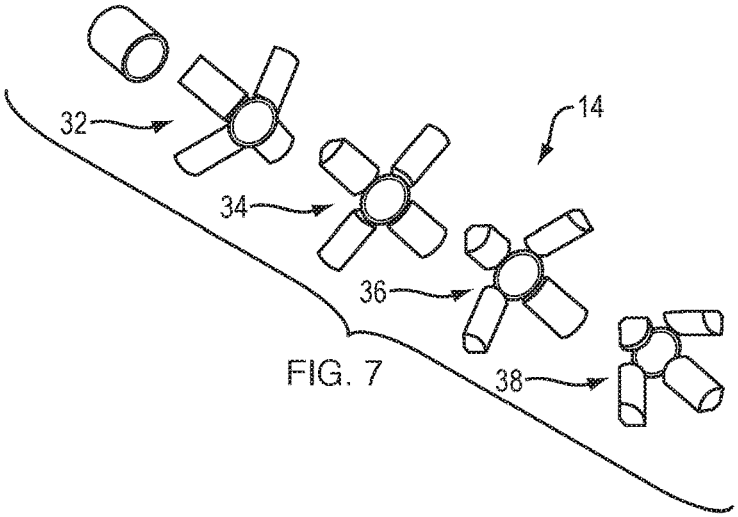

FIGS. 5-7 illustrate a second type of two-warhead munition 30 in which the segments 26 are forward of the first (shaped charge) warhead 12. In this case the munition 30 retains the capability of 90-degree outward rotation to produce forward-moving fragments, as for the warhead 20, and has additional capabilities as well. With the segments 26 being forward of the shaped charge warhead 12, the segments 26 can rotate forward more than 90 degrees. FIG. 5 illustrates rotation to approximately 135 degrees. Simultaneously detonating the segments 26 all at the same rotation angle produces an interesting effect. Fragment clusters of the segments 26 interact in a manner similar to a collapsing shaped charge liner. There are many fragment collisions on the warhead axis 16 from opposing and orthogonal directions that results in a stream of fragment material moving forward along the axis 16. This is described more below.

The munition 30 has the capability to transform its geometry in order to effectively attack any of several different target types. In its folded or stowed configuration, the munition 30 acts as a traditional sidewall fragmentation bomb. The warhead casings produce fragments that are distributed in a radial/lateral direction. This may be ideal for area targets such as dismounted personnel.

FIGS. 6 and 7 show various possible positions of deployment of the segments 26. In a first position 32, the sidewall sections are folded out less than 90 degrees. If detonated in this position, the fragmentation will be directed forward in a large cone. In a second position 34, the sections are at 90 degrees and the fragments are dispersed forward in a tighter pattern. The benefit of using the sidewall fragmentation in the forward direction is that, typically, many more fragments can be delivered from the sidewall than can be generated by typical fragmenting noses. The third and fourth positions 36, 38 show the sections folded out beyond 90 degrees and it is this configuration that takes the warhead effects beyond just blast and fragmentation. In these positions, the fragmentation collides on the axis and forms a high velocity jet that is capable of significant penetration into armored targets, buildings, and bunkers. For example, the jet may be capable of penetrating one to two calibers into RHA.

Thus the transformable warhead 14 has the ability to transform from a weapon with efficient area-target fragmentation effects, to one that directs all that fragmentation in the forward direction onto a point target, or to one that can penetrate medium armor, reactive armor, or structures. Segment rotation in a range of about 105 to 130 degrees produces what might be called a stretchy EFP or a very wide angle shaped charge. From about 130 degrees to about 145 degrees, a wide angle shaped charge is obtained, and a more conventional shaped charge is obtained from about 145 degrees to about 170 degrees. Thus, for different applications, rotation somewhere in the range of about 105 degrees to about 170 degrees gives practical jetting creating either an EFP or a shaped charge.

Figure 8:
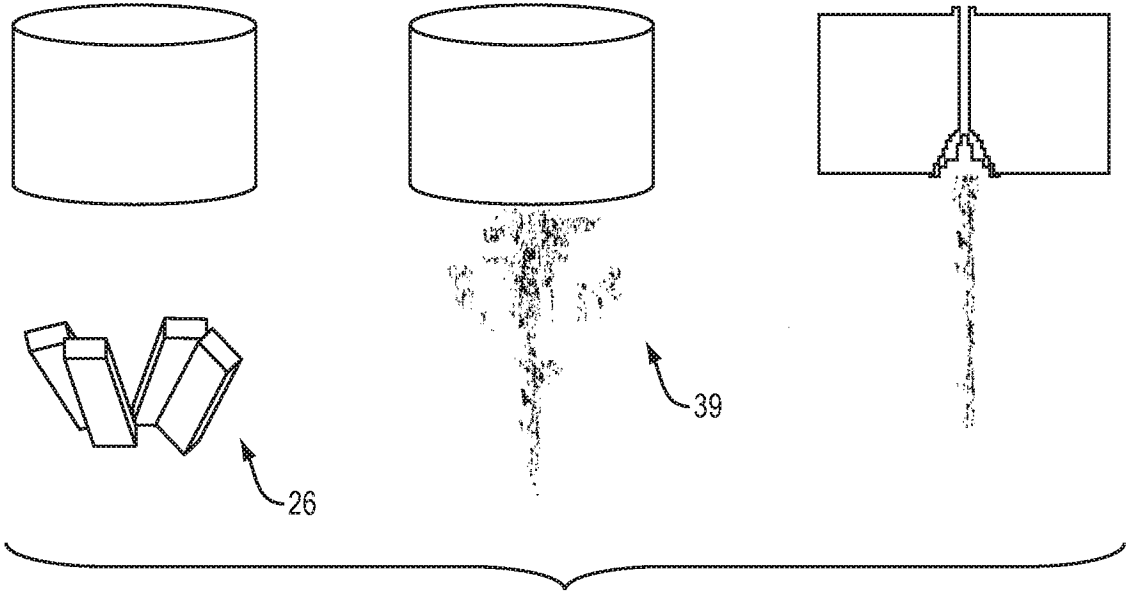
FIG. 8 is a schematic depiction of detonation of a transformable warhead.

FIG. 8 is a view illustrating detonation of a deployed transformable warhead 14. The image at left shows the four segments 26 rotated outward to 135 degrees, where they are simultaneously detonated. The center image shows a time after detonation where the fragments are forming a jet. There is significant mass in the jet which contains most of the fragment mass in the segmented warhead walls. This mass is concentrated in a region 39 referred to as a "focal region", i.e., a region to which the fragments from the segments 26 are all directed. The right image shows a later time when the jet has bored through a target. When the segmented warhead outer walls are naturally fragmenting tantalum, for example, the jet can perforate approximately two missile diameters into rolled homogenous armor (RHA), which may also be sufficient to initiate explosive reactive armor (ERA) for targets incorporating ERA. The jet may be capable of penetrating a significant thickness of masonry to create a large borehole, or perforating medium RHA such as a BMP. For a hard target such as a tank, the jet can act as a precursor for the main shaped charge jet (created by aft warhead 12) to initiate the tank's explosive reactive armor (ERA). Four tantalum-walled segments initiated simultaneously are able to perforate 6 inches of RHA at short standoff. In one embodiment the warhead segments 26 are 2" wide and 4.5" long.

It will be appreciated that there will be an effect on missile dynamics of rotating the warhead segments 26 into the airstream. One way to reduce the aerodynamic load is to make each of the rotating segments 26 smaller in width than a full quadrant (90 degrees) of the initial cylindrical warhead 14. Reducing the segments from 90 degrees to 45 degrees can serve several useful purposes. The number of segments can be increased to eight, with four being rotating and four being non-rotating. The aerodynamic load may be cut approximately in half. The non-rotating segments can be firmly attached to the missile and provide a structure for the hinges for the rotating segments. Fragments from the non-rotating segments provide radial area coverage to increase lethality against widely dispersed ground targets, while still allowing forward focused fragmentation in one of the warhead modes. For hard target (tank) attack, the non-rotating segments may not be detonated because they could interfere with the main shaped charge.

Figure 9:
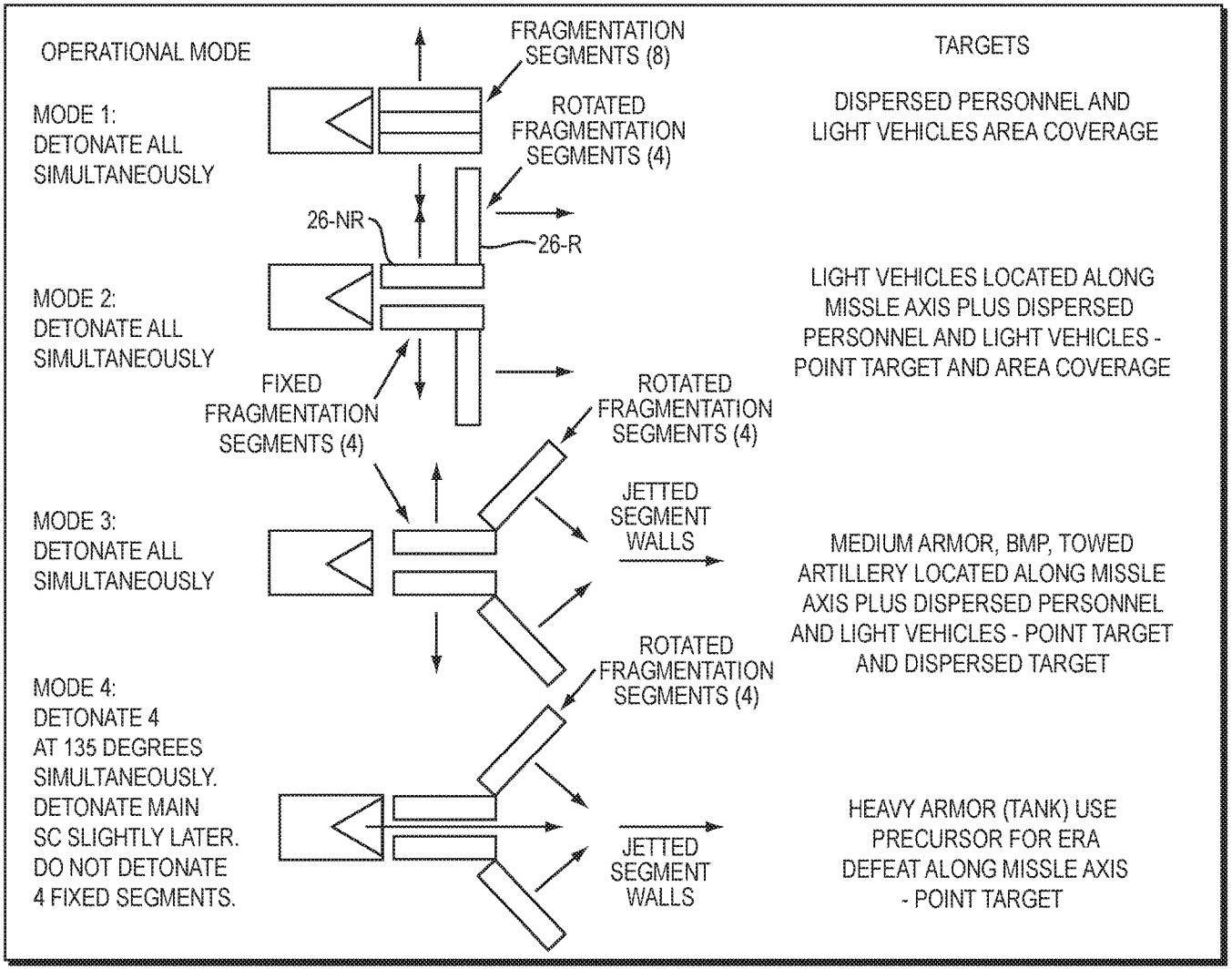
FIG. 9 is a schematic depiction of a set of deployment configurations of a transformable warhead.

FIG. 9 shows a set of deployment configurations (elevation view) of a munition 30 having eight segments as described above, including four rotating segments 26-R and four non-rotating segments 26-NR. Four types of deployment configurations are shown, some or all of which may require slightly different fuzing approaches. These configurations are described below. In FIG. 9, arrows are used to indicate the velocity direction of the fragments or jets. Roughly, the target hardness increases with mode number, with Mode 1 being deployed against dispersed personnel and Mode 4 against a hardened point target such as a tank.

In Mode 1, the transformable warhead 14 remains in the closed or stowed position. This configuration is intended to attack dispersed ground targets in an area coverage mode. In operation, a missile carrying the munition dives vertically until the proper altitude above ground level is reached, at which time all the segments 26 are detonated simultaneously to create a hail of fragments traveling radially outward. The main shaped charge 12 may have a slight delay. The main shaped charge jet is firing forward through the detonation products from the eight warhead segments 26, which tends to disperse the main shaped charge jet into a cloud of copper and other metal fragments in the downward direction.

Mode 2 in FIG. 9 is the forward focused fragmentation mode in which the four rotating warhead segments 26-R are rotated to 90 degrees. A switch is triggered as the rotated segments 26 deploy through 90 degrees at some known distance from a light vehicle target and the segments 26 are detonated at the same time (except possibly the main shaped charge is delayed). If a delivery missile is flying in a vertical dive there will be a radial cloud of fragments impacting any peripheral ground targets from the four non-rotating segments 26-NR. Directly ahead of the missile is where there will be a very large number of fragments from the four rotating segments 26-R as well as copper and other metal fragments from the main shaped charge jet that is passing through metal housing remnants and detonation products from the four non-rotating segments 26-NR. If the missile attacks along a horizontal trajectory, the forward focused fragment pattern will be the same but the radial fragment cloud will just cover a swath of ground perpendicular to the missile's velocity vector.

Mode 3 in FIG. 9 is the medium armor attack mode with collateral fragmentation. In this mode, the warhead segment jet is used as the primary kill mechanism because of the large borehole (greater than 1") produced through the relatively thin armor. Here the warhead segments 26-R are rotated to about 135 degrees, which may be accomplished for example by use of a hard stop and an inflated airbag to hold the segments 26-R in place. The four rotating segments 26-R are then detonated simultaneously to create a jet. The four fixed segments 26-NR are also detonated at the same time to produce a radial cloud of fragments that produces a swath of impacts on the ground with a pattern perpendicular to the missile axis. The shaped charge warhead 12 is detonated after a slight delay as before.

Mode 4 in FIG. 9 is the heavy armor attack mode. In this mode, the warhead segment jet is used as a precursor for the main shaped charge jet in order to initiate the ERA. The main shaped charge detonation is delayed to allow the ERA plates to move off the shot line. The non-rotating warhead segments 26-NR are not detonated in this mode as they may interfere with the main shaped charge jet. The main shaped charge blast may eventually initiate the fixed warhead segments.

Initiation trains for the transformable warhead 14 may consist of four equal lengths of deta-cord for the four non-rotating warhead segments 26-NR and another four equal lengths of deta-cord for the four rotatable warhead segments 26-R. Each set of four may have its own detonator/booster arrangement to insure initiation of the deta-cord. At the terminus of the deta-cord inside the warhead segment may be another booster to reliably initiate the segment's explosive charge. The main shaped charge 12 has its own detonator, so the system has a total of 3 detonators. The airbag (described more below) will also have an initiator. As an alternative, low energy exploding foil initiators (LEEFIs) can be used to detonate the individual warhead segments 26. LEEFIs may actually allow more flexibility in the number of modes of operation. This may allow asymmetric warhead configurations, for example, which could aim the rotatable segments 26-R based on exact target locations.

FIGS. 10 and 11 are schematic views of a transformable warhead 14 in a folded position, having four fixed (non-rotating) warhead segments F and four rotatable warhead segments R. FIG. 11 shows the warhead 14 without the rotating segments R. In this embodiment, a four-lobed airbag 40 is stowed inside a central perforated tube structure 42 and used to deploy the rotating segments R by inflating upon command. In one example, a cool gas airbag system operating at several hundred psi is used to both deploy and stabilize the rotating segments R. The airbag 40 rotates the warhead segments R until they reach a stop and then maintains pressure against the stop. In one example, a highly reinforced hinge similar to one type of door hinge may be used, which can only rotate to a certain angle before the hinge halves interfere, creating the desired stop.

The fixed warhead segments F may be stiff and attached to endplates (not shown) as well as to the perforated tube 42 through which the airbag lobes push the rotatable warhead segments R to deploy them. The rotatable warhead segments R may be wider or narrower than the fixed warhead segments F, but should be identical among themselves to create the jet.

The transformable warhead structure could be fabricated from steel or possibly aluminum but needs to have a high strength-to-weight ratio. A single airbag 40 having four lobes may be a good choice since the pressure history in each interconnected lobe should be similar thereby making the rotation of each warhead segment R similar. This is adequate for the 90 degree forward fragmentation function (light vehicle attack). For medium or heavy armor attack, the warhead segments need to be further rotated (e.g., to 135 degrees) and aligned to create the jetting. Sufficient time for the full rotation of all the segments can be allowed since the segments will reach a stop and continue to be pushed (held) against the stops by the high pressure in the airbag 40.

FIGS. 12-13 illustrate an arrangement for a transformable warhead at a nose member 50 of a missile or similar munition. FIG. 12 shows the folded position, and FIG. 13 shows the open or deployed position. As shown, the segments 26 are spaced away from the point of rotation 52 so that they become spaced from the nose member 50 when open. This arrangement can help avoid any impact to the missile nose member 50 upon detonation of the segments 26.

Figure 14:
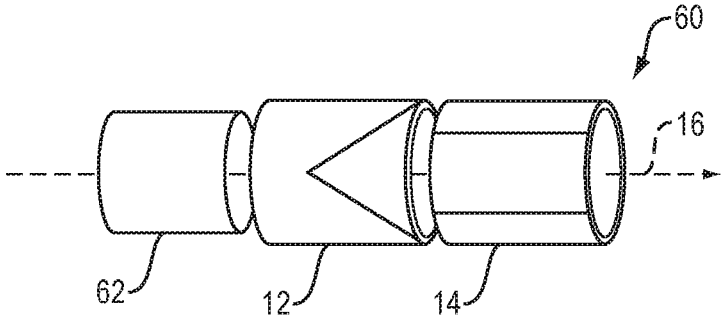
FIG. 14 is a quasi-mechanical diagram of a multi-warhead munition.

FIG. 14 depicts a three-warhead munition 60 according to one embodiment. In addition to the first and second warheads 12, 14, it includes an aft third warhead 62 that may be used for a "follow-through" effect after the first and second warheads 12, 14 have created an opening in a structure. The third warhead may be a grenade-type explosive or thermobaric warhead.

Figure 15:
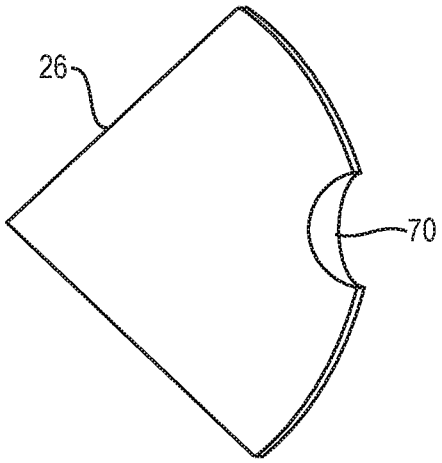
FIG. 15 is a schematic section view of a segment of a transformable warhead.

FIG. 15 shows a possible arrangement for the segments 26, namely use of a liner 70 to create an explosively formed penetrator (EFP) upon detonation.

Figure 16:
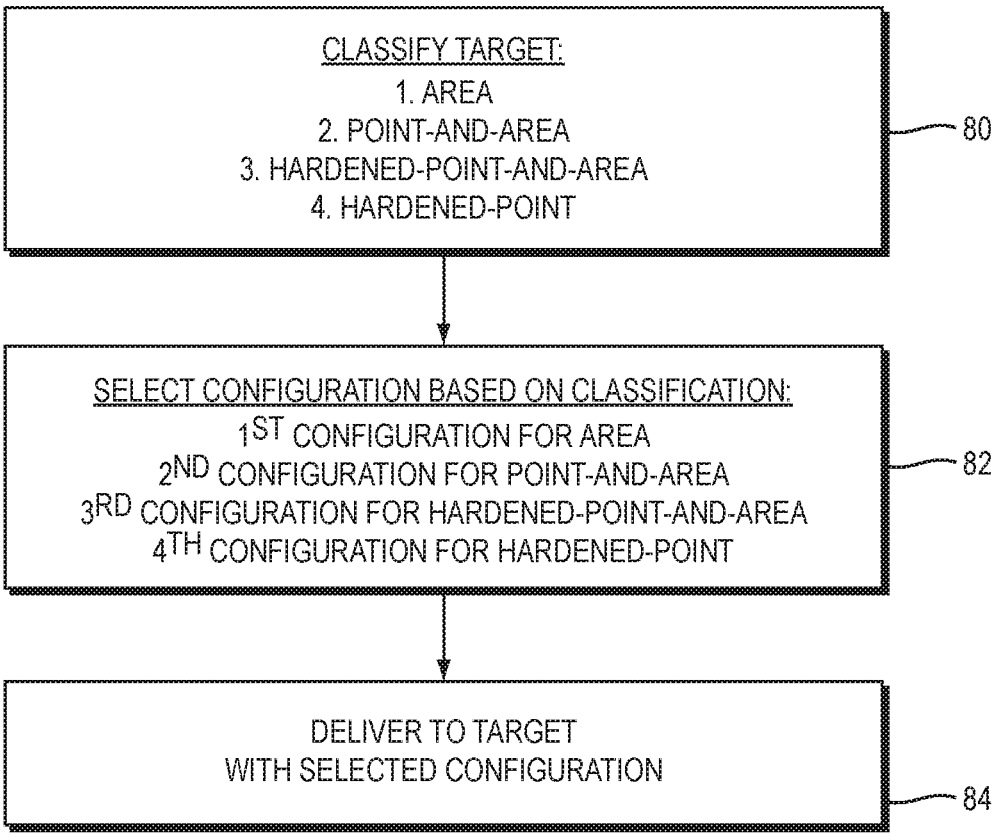
FIG. 16 is a flow diagram of configuration and deployment of a multi-warhead munition having a transformable warhead.

FIG. 16 illustrates a method of engaging a target with a multi-warhead munition (e.g., 30) that includes a cylindrical shaped charge warhead aft of a cylindrical transformable warhead. As mentioned above, this method may be performed by some combination of human action and machine action.

At 80, the target is classified as one of an area target, a point-and-area target, a hardened-point-and-area target, and a hardened-point target.

At 82, a configuration of the transformable warhead is selected based on the classification of the target, including:

Selecting a first configuration based on classifying the target as an area target, the first configuration having (1) segments of the transformable warhead in a folded position to generate a hail of fragmentation projectiles radially away from the munition upon detonation, and (2) first and second detonators configured to detonate the shaped charge warhead and transformable warhead simultaneously.

Selecting a second configuration based on classifying the target as a point-and-area target, the second configuration having (1) segments of the transformable warhead in a first open position to generate a hail of fragmentation projectiles axially forward upon detonation, the segments being rotated away from an axis of the munition to a first rotation angle of substantially 90 degrees to direct respective segment faces in a forward direction, and (2) the first and second detonators configured to detonate the shaped charge warhead and transformable warhead simultaneously.

Selecting a third configuration based on classifying the target as a hardened-point-and-area target, the third configuration having (1) the segments of the transformable warhead in a second open position to generate a hail of fragmentation projectiles axially forward upon detonation, the segments being rotated away from the axis of the munition to a second rotation angle of greater than 90 degrees to point the segment faces to a focal region ahead of the munition, and (2) the first and second detonators configured to detonate the shaped charge warhead and transformable warhead simultaneously.

Selecting a fourth configuration based on classifying the target as a hardened-point target, the fourth configuration having (1) the segments of the transformable warhead in the second open position, and (2) the first and second detonators configured to detonate the shaped charge warhead after detonating the transformable warhead.

At 84, the munition with the selected configuration is delivered to the target for detonation.

While various embodiments of the invention have been particularly shown and described, it will be understood by those skilled in the art that various changes in form and details may be made therein without departing from the scope of the invention as defined by the appended claims.

What is claimed is:

1. A multi-warhead munition, comprising:

a first cylindrical warhead having a cavity filled with high explosive;

a second cylindrical warhead offset axially from the first cylindrical warhead, the second cylindrical warhead being a segmented warhead including a plurality of segments, each segment having an outer segment face bounding a cavity of the segment filled with high explosive, the segments being elongated and mounted at one end for rotation away from an axis of the munition to an open position in which the segment faces are pointed in a forward direction for detonation; and first and second detonators for the first and second cylindrical warheads respectively, the second detonator being configured and operative to simultaneously detonate the segments of the second cylindrical warhead, wherein the second cylindrical warhead is disposed axially forward of the first cylindrical warhead, and wherein the segments of the second cylindrical warhead are mounted for rotation by a rotation angle greater than 90 degrees toward a focal region at which each of the segment faces is pointed, the focal region located on the axis of the munition at a forward end of the second cylindrical warhead.

2. The multi-warhead munition of claim 1, wherein the rotation angle is in a range between 105 degrees and 170 degrees.

3. The multi-warhead munition of claim 1, wherein the first and second detonators are co-configured to detonate the second cylindrical warhead before the first cylindrical warhead.

4. The multi-warhead munition of claim 1, wherein the second cylindrical warhead is configurable into a plurality of deployment configurations including a folded configuration and an open configuration, the open configuration having the segments rotated away from the axis of the munition by the rotation angle of greater than 90 degrees, the folded configuration having the segments extending parallel to the axis of the munition with the segment faces pointed radially away from the axis of the munition for detonation.

5. The multi-warhead munition of claim 4, wherein the open configuration is a first open configuration and the rotation angle of greater than 90 degrees is a first rotation angle, and wherein the deployment configurations further include a second open configuration having the segments rotated away from the axis of the munition by a second rotation angle of substantially 90 degrees for detonation.

6. The multi-warhead of claim 5, wherein the deployment configurations include two variants of the first open configuration, a first variant having the first and second detonators configured and operative to simultaneously detonate the first cylindrical warhead and the segments of the second cylindrical warhead, the second variant having the first and second detonators configured and operative to detonate the segments of the second cylindrical warhead before detonating the first cylindrical warhead.

7. The multi-warhead munition of claim 1, wherein the segments are rotating segments and the second cylindrical warhead further includes non-rotating segments extending parallel to the axis of the munition with segment faces pointed radially away from the axis of the munition for detonation.

8. The multi-warhead munition of claim 7, wherein the second cylindrical warhead is configurable into a plurality of deployment configurations including first and second configurations, the first configuration having the second detonators configured and operative to detonate the rotating and non-rotating segments simultaneously, the second configuration having the second detonators configured and operative to detonate the rotating segments without detonating the non-rotating segments.

9. The multi-warhead munition of claim 1, further including a nose member to which the segments are hingedly attached for rotation.

10. The multi-warhead munition of claim 9, wherein the segments are spaced from a point of hinged attachment to become spaced from the nose member in the open position to locate the focal region ahead of the nose member.

11. The multi-warhead munition of claim 1, further including a third cylindrical warhead axially displaced from the first and second cylindrical warheads.

12. The multi-warhead munition of claim 11, wherein the second cylindrical warhead is located forward of both the first and third cylindrical warheads.

13. The multi-warhead munition of claim 12, wherein the first cylindrical warhead is a shaped charge warhead located aft of the second cylindrical warhead, and the third cylindrical warhead is a thermobaric warhead located aft of the first cylindrical warhead.

14. The multi-warhead munition of claim 1, wherein each of the segment faces includes a respective elongated liner configured to form a penetrating slug upon detonation of the segment.

15. The multi-warhead munition of claim 1, wherein the segments are linear segments with wedge-shaped cross sections having respective interior apexes facing the axis of the munition when the segments are in a folded, non-rotated position.

16. A method of engaging a target with a multi-warhead munition including a cylindrical shaped charge warhead aft of a cylindrical transformable warhead, comprising:

classifying the target as one of an area target, a point-and-area target, a hardened-point-and-area target, and a hardened-point target;

selecting a configuration of the transformable warhead based on the classifying of the target, including:

selecting a first configuration based on classifying the target as an area target, the first configuration having (1) segments of the transformable warhead in a folded position to generate a hail of fragmentation projectiles radially away from the munition upon detonation, and (2) first and second detonators configured to detonate the shaped charge warhead and transformable warhead simultaneously;

selecting a second configuration based on classifying the target as a point-and-area target, the second configuration having (1) segments of the transformable warhead in a first open position to generate a hail of fragmentation projectiles axially forward upon detonation, the segments being rotated away from an axis of the munition to a first rotation angle of substantially 90 degrees to direct respective segment faces in a forward direction, and (2) the first and second detonators configured to detonate the shaped charge warhead and transformable warhead simultaneously;

selecting a third configuration based on classifying the target as a hardened-point-and-area target, the third configuration having (1) the segments of the transformable warhead in a second open position to generate a hail of fragmentation projectiles axially forward upon detonation, the segments being rotated away from the axis of the munition to a second rotation angle of greater than 90 degrees to point the segment faces to a focal region ahead of the munition, and (2) the first and second detonators configured to detonate the shaped charge warhead and transformable warhead simultaneously; and selecting a fourth configuration based on classifying the target as a hardened-point target, the fourth configuration having (1) the segments of the transformable warhead in the second open position, and (2) the first and second detonators configured to detonate the shaped charge warhead after detonating the transformable warhead; and delivering the munition with selected configuration to the target for detonation.

17. A method according to claim 16, wherein the selecting is performed prior to launch of the munition from a vehicle.

18. A method according to claim 16, wherein the munition includes target acquisition electronic circuitry operative to automatically perform the classifying and selecting during delivery of the munition to the target.

* * * * *